US012465126B1

(12) United States Patent
Henderson

(10) Patent No.: US 12,465,126 B1
(45) Date of Patent: Nov. 11, 2025

(54) HAIR CURLER SYSTEM AND METHOD OF USE

(71) Applicant: Donna L. Henderson, Phoenix, AZ (US)

(72) Inventor: Donna L. Henderson, Phoenix, AZ (US)

( * ) Notice: Subject to any disclaimer, the term of this patent is extended or adjusted under 35 U.S.C. 154(b) by 358 days.

(21) Appl. No.: 17/971,940

(22) Filed: Oct. 24, 2022

Related U.S. Application Data

(60) Provisional application No. 63/271,341, filed on Oct. 25, 2021.

(51) Int. Cl.
*A45D 2/12* (2006.01)
*A45D 2/14* (2006.01)
*A45D 7/00* (2006.01)

(52) U.S. Cl.
CPC ..... *A45D 2/127* (2013.01); *A45D 2/146* (2013.01); *A45D 7/00* (2013.01)

(58) Field of Classification Search
CPC . A45D 2/127; A45D 2/02; A45D 2/12; A45D 2/18; A45D 2/24; A45D 2/08
See application file for complete search history.

(56) References Cited

U.S. PATENT DOCUMENTS 1,009,923 A 11/1911 Moll
1,612,911 A 1/1927 Durnerin
1,710,216 A 4/1929 James
1,994,099 A 3/1935 Fulton
2,166,386 A 7/1939 Auster
2,524,266 A 10/1950 Licastro
2,602,459 A 7/1952 Gudat
2,631,594 A 3/1953 Klein
2,871,865 A 2/1959 Anderson
3,255,765 A 6/1966 Sturdivant
5,411,040 A * 5/1995 Forrest ..... A45D 2/12 132/246
7,305,995 B2 12/2007 Tojo et al.
7,963,291 B2 6/2011 Tojo et al.
8,997,758 B1 4/2015 Davenport
9,439,489 B1 * 9/2016 Townsell ..... A45D 8/34
9,844,252 B2 12/2017 Kraszewski et al.

* cited by examiner

*Primary Examiner* — Rachel R Steitz
(74) *Attorney, Agent, or Firm* — Bold IP, PLLC; Houda El-Jarrah

(57) ABSTRACT

A hair curling system that comprises fabric based hair curling system that does not require damaging heat or for the user to wet the user's hair in order for the hair curling system to provide defined and stylish curls to a user's hair. The hair curling system includes a hair curler made up of a hair tie attached to a top open end of an elongated section of fabric that has a closed left side and a closed right side, and an open bottom end. The user inserts a desired amount of hair through the elongated section of fabric and rolls that section of fabric towards the user's head and ties the contained or inserted amount of hair contained in the elongated section of fabric of the hair curler. A detachable pocket dedicated to holding another physical hair curler can be added to add further tightness to a user's curls.

10 Claims, 18 Drawing Sheets

HAIR CURLER SYSTEM AND METHOD OF USE

CROSS-REFERENCE TO RELATED APPLICATIONS

This application is a non-provisional application which claims priority to U.S. Provisional Patent Application No. 63/271,341 filed on Oct. 25, 2021, which is incorporated by reference in its entirety.

FIELD OF THE DISCLOSURE

This present disclosure generally relates to a hair curling system that may be used to create a natural set of curls for the user without the need for heat to be applied to the hair, without requiring the user to have wet hair prior to curling, and provides a method for hair curling that avoids any damage while styling one's hair.

BACKGROUND

Having styled and attractive looking hair is highly desirable and may also be a requirement for many professions and occasions. While there are many styling tools available for styling hair, the existing set of styling tools require the use of heating products, including blow dryers or hair curlers or hair diffusers to style the hair. This is particularly true for when the user wants to create a natural looking set of curls and waves that appear styled and orderly and beautiful. The conventional process for curling one's hair requires the use of damaging heat-based tools, such as curling irons, blow dryers, and diffusers which can damage the hair over time and cause dryness, split ends and burnt hair. Further, it is usually required for the user's hair to be wet or loaded with styling products, such as creams and curling solutions to promote the curling and styling.

Accordingly, there is a need for a hair styling and curling system that does not damage the hair and provides a fresh, beautiful head of curled hair without the need for the hair to be wet or to use damaging heat-based tools.

SUMMARY

The present description is directed to a hair curling system comprising a hair curler having a hair tie and an elongated double open ended hair pocket. The double open ended hair pocket comprises an elongated section of fabric with a top open end, a bottom open end, a closed left side, and a closed right side. The top open end may be referred to as the tie side of the double open ended hair pocket. The elongated section of fabric (i.e., the double open ended hair pocket and curler) may further comprise a cavity within the elongated section of fabric that extends from the top open end to the bottom open end. A hair tie may be attached to a top edge of the top open end of the elongated section of fabric, whereby the hair curler is configured to be used to curl a desired amount of hair. A first fastener may be attached to a center piece of the hair tie.

Further, the hair curling system may include a removable and detachable pocket made of fabric that has an interior cavity configured to receive a separate hair roller. The detachable pocket comprises a second corresponding fastener to mate with the first fastener to removably attach the detachable pocket to the elongated section of fabric. An advantage of the detachable and removable hair pocket is that when a separate hair roller is added within the detachable pocket and used to roll curls on a user's head, the produced curls are tighter and have more definition than the possibly looser set of curls produced without the use of the detachable pocket and separate hair roller.

In a non-limiting embodiment, the hair curler is made of cloth. Further, in a non-limiting embodiment, the hair curler comprises a lining which may be made of a silky fabric in one or more non-limiting embodiments. Further, the first fastener and the second corresponding fastener may be made from hook and loop fasteners (e.g., VELCRO) in a non-limiting embodiment. In a non-limiting embodiment, the width of the hair tie may be wider than a width of the elongated section of fabric. Further, a length of the detachable pocket may be shorter than a length of the elongated section of fabric. Further, in a non-limiting embodiment, the second corresponding fastener is located generally near a top edge of a back side of the detachable pocket in order to attach to the first fastener attached to the center piece of the hair tie.

In a non-limiting embodiment, a method for curling hair without using water or heat is described herein. The method may include providing a hair curling system comprising a hair curler comprising an elongated section of fabric with a top open end and a bottom open end, and a closed left side and a closed right side, whereby a cavity extends within the elongated section of fabric. Further, a hair tie may be attached to the top open end of the elongated section of fabric, whereby the top open end of the elongated section of fabric is also known as a tie side, whereby the hair curler is configured to be used to curl a desired amount of hair, wherein a first fastener is attached to a center piece of the hair tie. The method may include inserting two fingers into the tie side of the elongated section of fabric until reaching through to the bottom open end and pulling a desired amount of hair into the top open end of the elongated section of fabric and through the cavity of the elongated section of fabric.

The method may further include holding the desired amount of hair inserted in the cavity of the elongated section of fabric, rolling the elongated section of fabric towards a head of a user while keeping a desired amount of tension on the elongated section of fabric until reaching the head of the user, and tying the hair tie around hair roots of the inserted desired amount of hair to secure the elongated section of fabric in order to curl a user's hair. The method may include repeating the above identified steps until a desired amount of hair curlers are in place on a user's head. The method may also include leaving the hair curlers in place on the user's head for a desired period of time to curl the user's hair and untying each hair curler to reveal a styled user's hair with defined curls. The method may further include attaching a detachable pocket to the first fastener on the elongated section of fabric, whereby the detachable pocket comprises an interior cavity configured to receive a separate hair roller that adds further tightness and definition to a curl produced by the hair curler to the inserted desired amount of hair. In a non-limiting embodiment, the detachable pocket comprises a second corresponding fastener to mate with the first fastener to removably attach the detachable pocket to the elongated section of fabric. Further, the method may further comprise, while holding the desired amount of hair inserted in the cavity of the elongated section of fabric and while the detachable pocket having the separate hair roller is attached to the first fastener on the elongated section of fabric, rolling the elongated section of fabric towards a head of a user while keeping a desired amount of tension on the elongated section of fabric until reaching the head of the user.

Other aspects and advantages of the invention will be apparent from the following description and the appended claims.

BRIEF DESCRIPTION OF THE DRAWINGS

The preceding and following embodiments and descriptions are for illustrative purposes only and are not intended to limit the scope of this disclosure. Other aspects and advantages of this disclosure will become apparent from the following detailed description.

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

The present description relates to one or more non-limiting embodiments for a hair curling system. In a non-limiting embodiment, the hair curling system uses items that are primarily made from cloth and silk to minimize any damage to the user's hair. The hair curler, as described herein can assist the user in achieving a head of hair that looks styled and includes many natural looking curls and waves without the need to damage the hair by using heat-based tools, such as blow dryers and curling irons. The hair curler, as described herein in one or more non-limiting embodiments, can be combined with a selected amount of hair, rolled, and left in the hair for a period of time in order to cause the selected amount of hair to curl naturally or to have a natural looking wave. More details are provided below with respect to the one or more Figures.

Figure 1A:
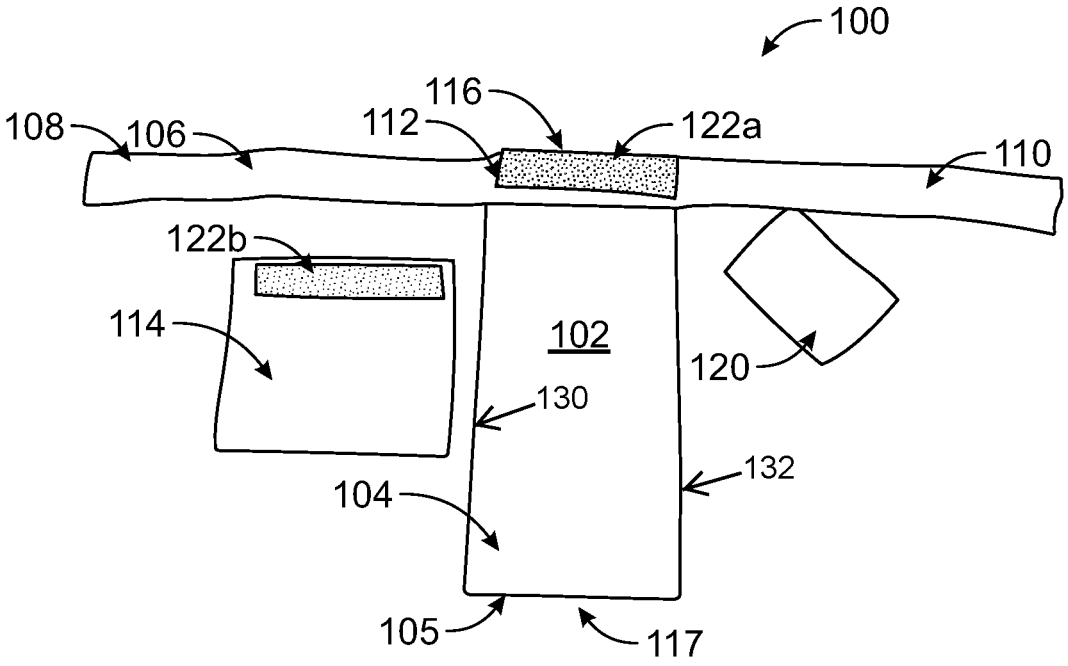
FIG. 1A depicts a pictorial illustration of a close up view of a hair curler in more detail and an additional hair roller pocket that can be added to the hair curler.
Figure 1B:
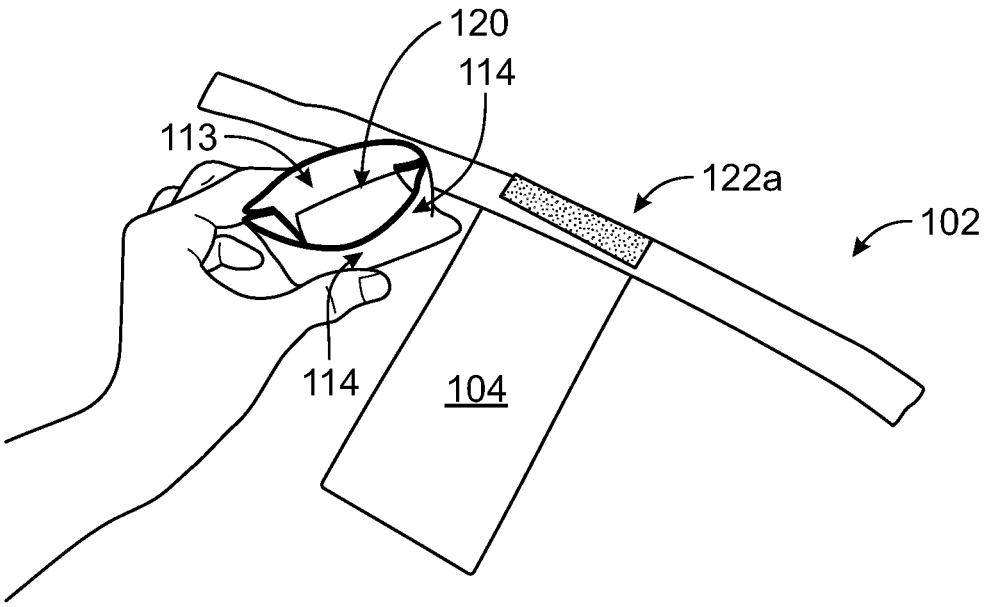
FIG. 1B depicts a pictorial illustration of a close up view of the hair curler with a hair roller placed within the pocket of the roller pocket.
Figure 1C:
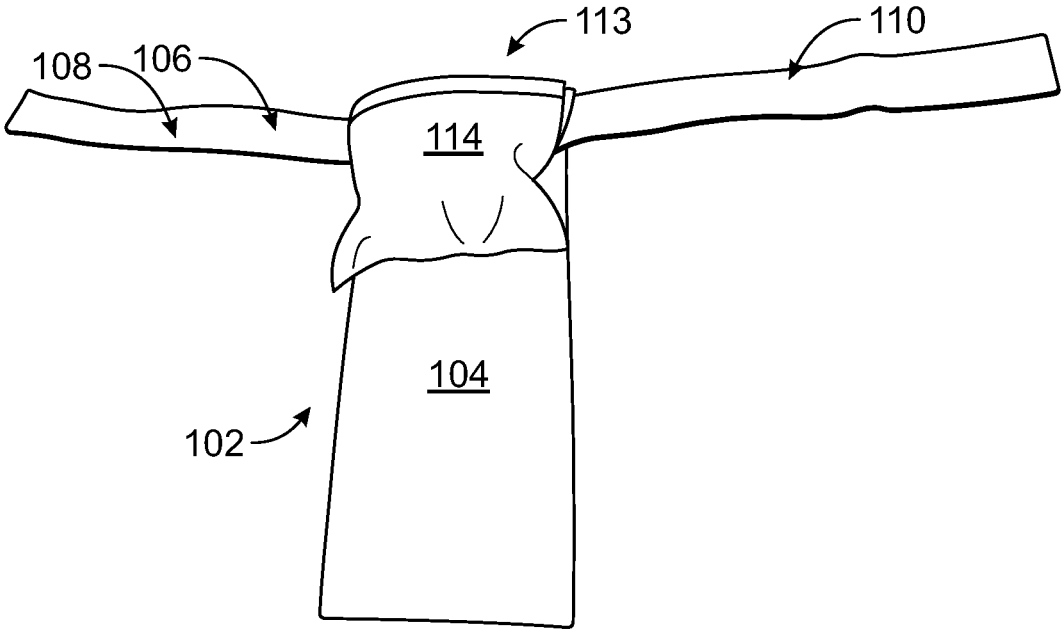
FIG. 1C depicts a pictorial illustration of the roller pocket with the included hair roller attached to a top of the hair curler.

FIGS. 1A-1C show various views of a hair curler system 100. In a non-limiting embodiment, the hair curler system 100 includes a hair curler 102 comprising a double open ended hair pocket 104. Further, the hair curler system 100 comprises a separate and detachable hair roller pocket 114 configured to hold a roller 120 that is attachable to the hair curler 102 to add extra definition and body to the produced hair curl in one or more non-limiting embodiment.

FIG. 1A shows a high-level view of a hair curler 102 and a hair roller pocket 114, a pictorial illustration of a non-limiting embodiment for a hair curler system 100 and apparatus and method of use. FIG. 1B-1C provide close up views of the hair curler 102 as well as the separate, detachable roller pocket 114 according to one or more non-limiting embodiments.

As shown in FIG. 1A and FIG. 1B, the hair curler 102 may be a single piece that includes a pocket 104 that is open at both the top end 116 and the bottom end 117, whereby the pocket 104 has an internal cavity accessible from either the top end 116 or the bottom end 117. Further, the pocket has a closed left side 130 and a closed right side 132. As used herein, the pocket 104 may also be referred to as an elongated section of fabric and/or a double open ended hair pocket.

Figure 8:
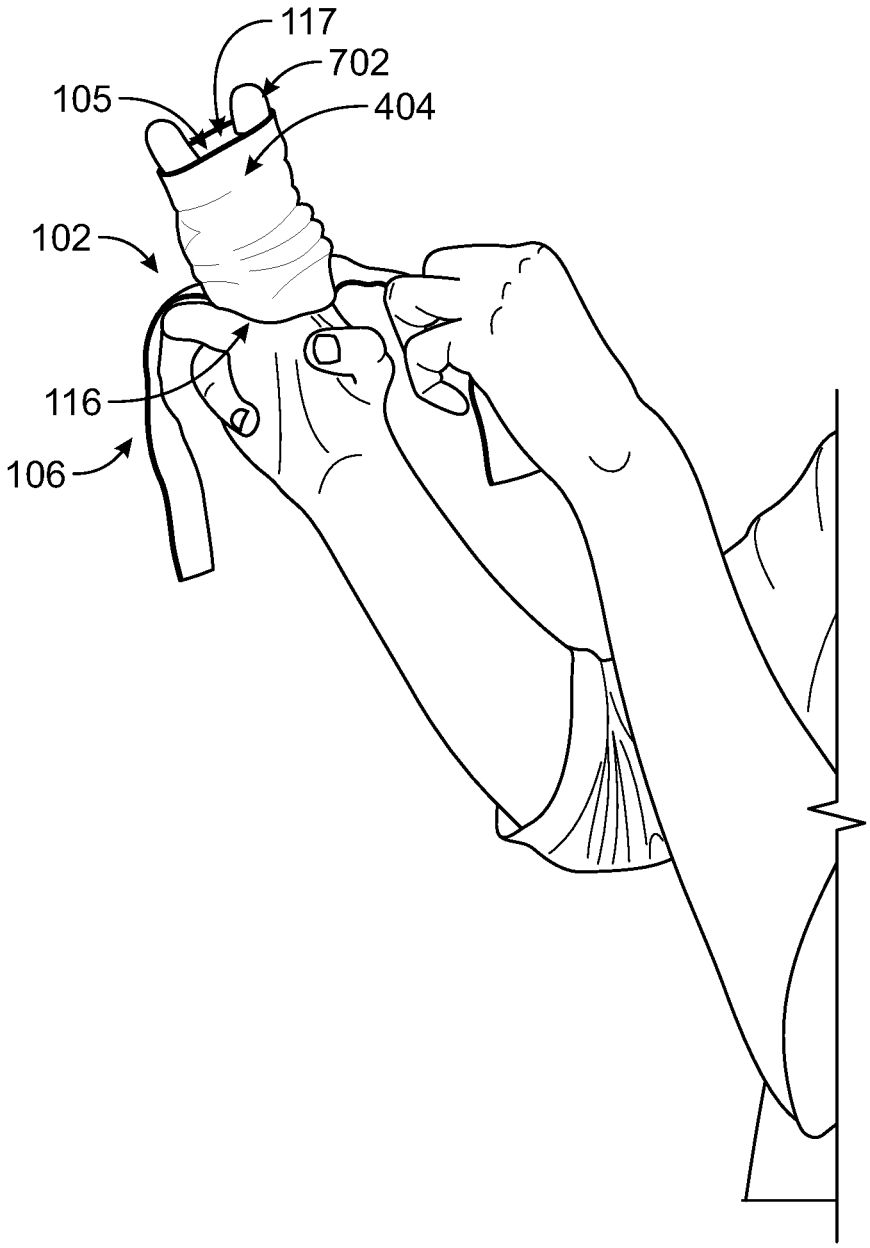
FIG. 8 depicts a pictorial illustration of two fingers inserted into the opening of the hair curler in preparation for inclusion in a user's hair.

As shown later below in FIG. 8, it is intended that a user can insert the user's fingers through the pocket 104 of the hair curler 102 through the top end 116 and the bottom end 117 into the internal cavity 105 of the pocket 104 of the hair curler 102. In a non-limiting embodiment, the hair pocket 104 is generally rectangular shaped.

Figure 4:
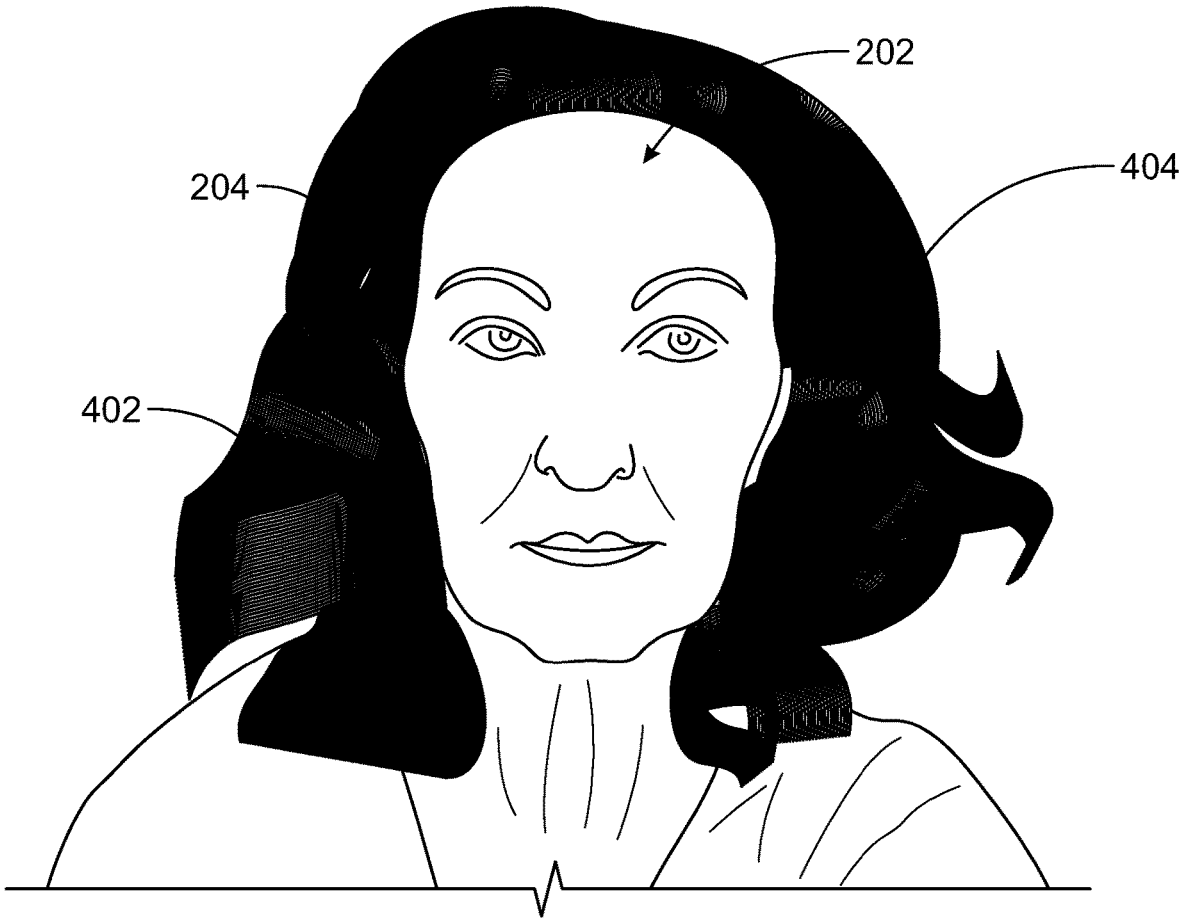
FIG. 4 depicts a pictorial illustration of the user after having removed the hair curlers and showing styled hair having natural looking curls and waves.
Figure 5:
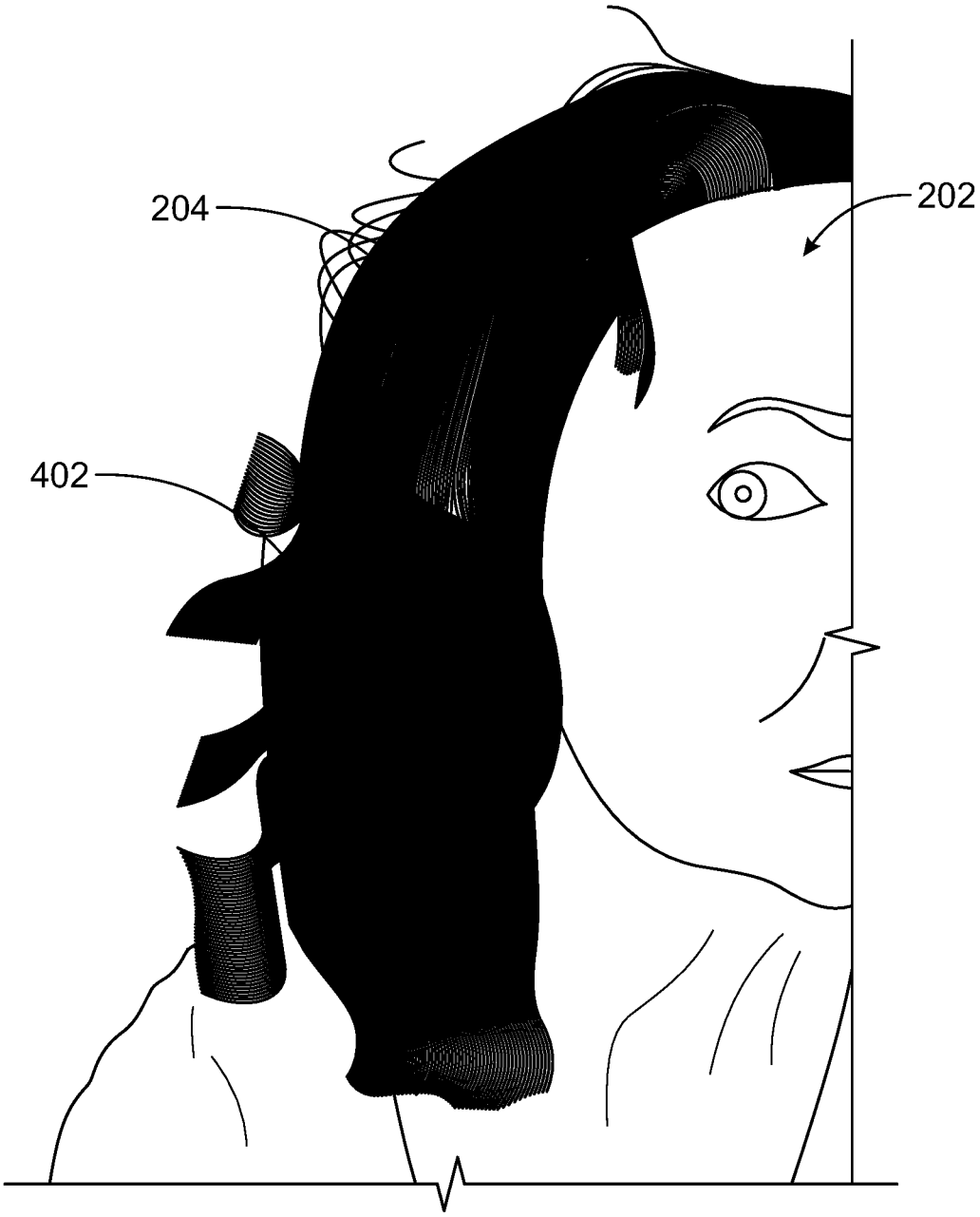
FIG. 5 depicts another pictorial illustration of the user having natural looking curls and waves after having used the one or more hair curlers.

The hair curler 102 may further include an incorporated hair tie 106 that has a first end 108, a central area 112, and a second end 110, whereby the second end 110 is opposite the first end 108. In one or more nonlimiting embodiments, as shown in FIG. 1B, there may be one or more pieces of a first fastener 122*a* attached over the central area 112 and/or on the ends of the first end 108 and/or second end 110 of the hair tie portion 106 of the hair curler 102. In a non-limiting embodiment, the first fastener 122*a* (and the second corresponding fastener 122*b* on detachable pocket 114) are made of hook and loop fasteners, such as, but not limited to the brand known as VELCRO. In other embodiments, as an alternative to using hook and loop fasteners for first fastener 122*a* and/or second corresponding fastener 122*b*, or in addition thereto, the hair curler 102 may incorporate the use of snaps, buttons, or other fasteners or attachment mechanisms. Hair curler 102, as shown in one or more non-limiting embodiments, may be used to curl a user's hair as shown in FIGS. 4-5 to achieve a nicely styled head of hair with natural looking curls and waves.

As shown in FIGS. 1A-1C, the hair tie 106 may be an elongated thin piece that includes a first tie end 108 and a second tie end 110 joined together by a central area 112. The central area 112 may be joined with a surface of the open-ended pocket 104. The open-ended pocket 104 may be made of an elongated piece of cloth and/or alternative types of fabric having a first open end 116 located aligned or in conjunction with the hair tie 106 and a second open end 117 at the opposite end of the hair curler 102.

The hair curler system 100 may further include a removably detachable roller pocket 114, as shown in FIGS. 1A-1C. The detachable roller pocket 114 may be closed on a bottom end, but may include an internal cavity or opening 113 that is configured to receiving and holding a hair roller, such as a hand-held, tangible, and separate hair roller 120. In a non-limiting embodiment, the separate hair roller 120 may be a smaller sized foam roller that can be inserted within the internal cavity 113 of the detachable hair pocket. In other non-limiting embodiments, the hair roller 120 may be made of any other kind of material, including, but not limited to, plastic.

FIG. 1B shows that the hair roller 120 may be placed within the opening 113 of the detachable roller pocket 114. Once the roller 120 has been placed within the opening 113 of the detachable roller pocket 114, the second corresponding fastener **122*b* included on one side of the detachable roller pocket 114, as shown in FIG. 1A, may be connected to the first fastener 122*a* located on the central area 112 of the hair curler 102, as also shown in FIG. 1C. FIG. 1C shows the combination or assembly of the detachable hair roller pocket 114 on the hair curler 102 and prepared for placement on a section of a user 202's hair 204 for rolling and to produce natural looking curls 402 and waves 404. The opening or internal cavity 113 within the detachable pocket 114 may be defined by a top open end on the detachable pocket 114, a closed left side, a closed right side, and a closed bottom side for the detachable pocket 114**.

Figure 13:
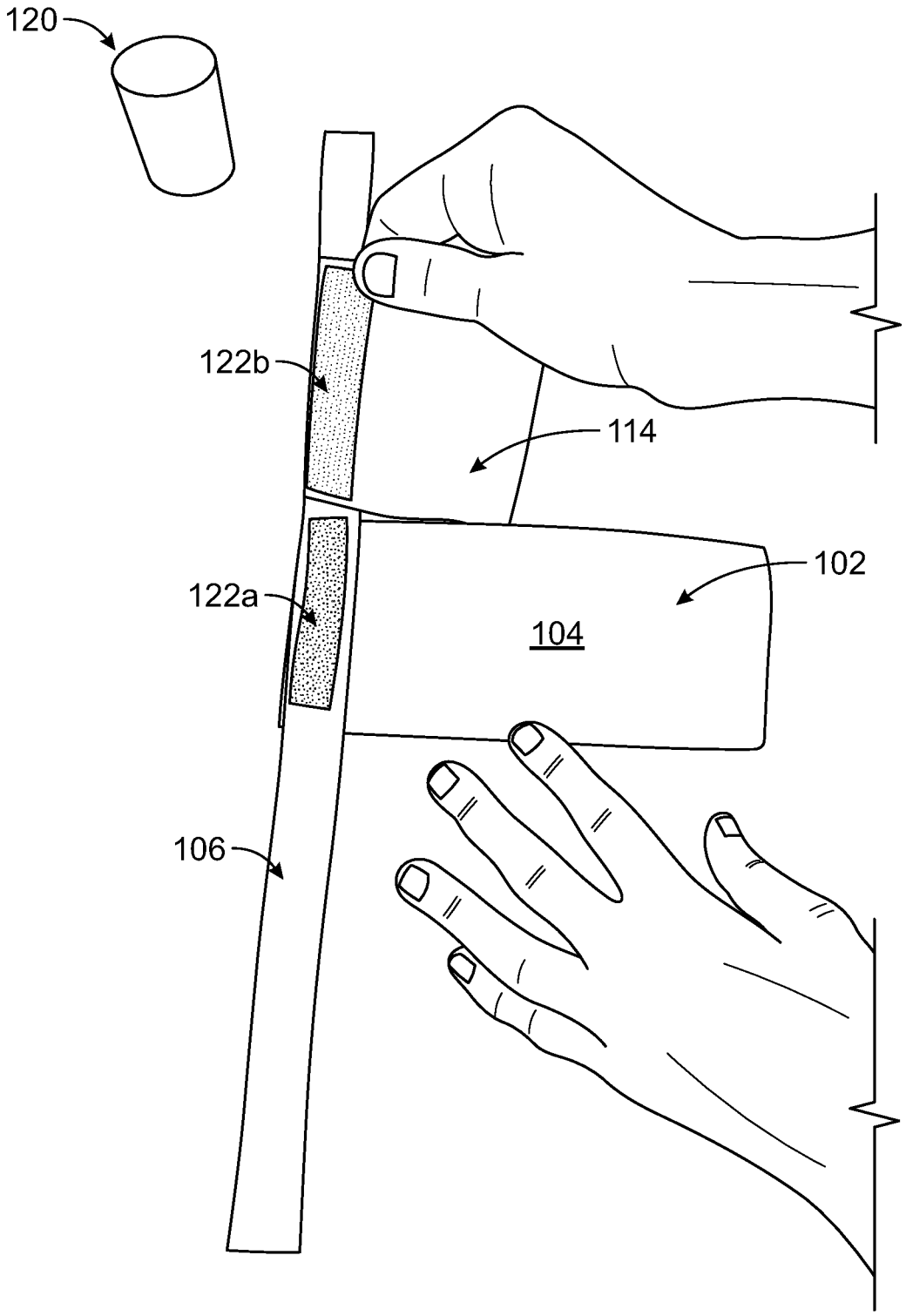
FIG. 13 depicts a pictorial illustration of a close up view of the hair curler and detachable hair pocket in position to be attached to the hair curler.

FIGS. 13-16 are directed primarily to further illustrating how the detachable pocket 114 may connect to the pocket 104 of the hair curler 102 according to a non-limiting embodiment. As shown in FIG. 13, the back side of the detachable pocket 114 should be facing a front side of the hair curler 102 and a front side of the hair pocket 104. Accordingly, the second corresponding fastener **122*b* is positioned near a top edge of the detachable pocket 114 in order to mate with the first fastener 122*a* that is positioned generally centrally on the hair tie 106. As shown in FIG. 13 the user can positioned the detachable pocket 114 to fit onto and over the hair pocket 104 of the hair curler 102 by mating the first fastener 122*a* and the second corresponding fastener 122*b* together. As shown in FIG. 13, the width of the detachable pocket 114 may generally be the same as the width of the hair pocket 104 of the hair curler 102. Further, the length of the detachable hair pocket 114 may be shorter than the length of the hair pocket 104 of the hair curler 102**.

Figure 14:
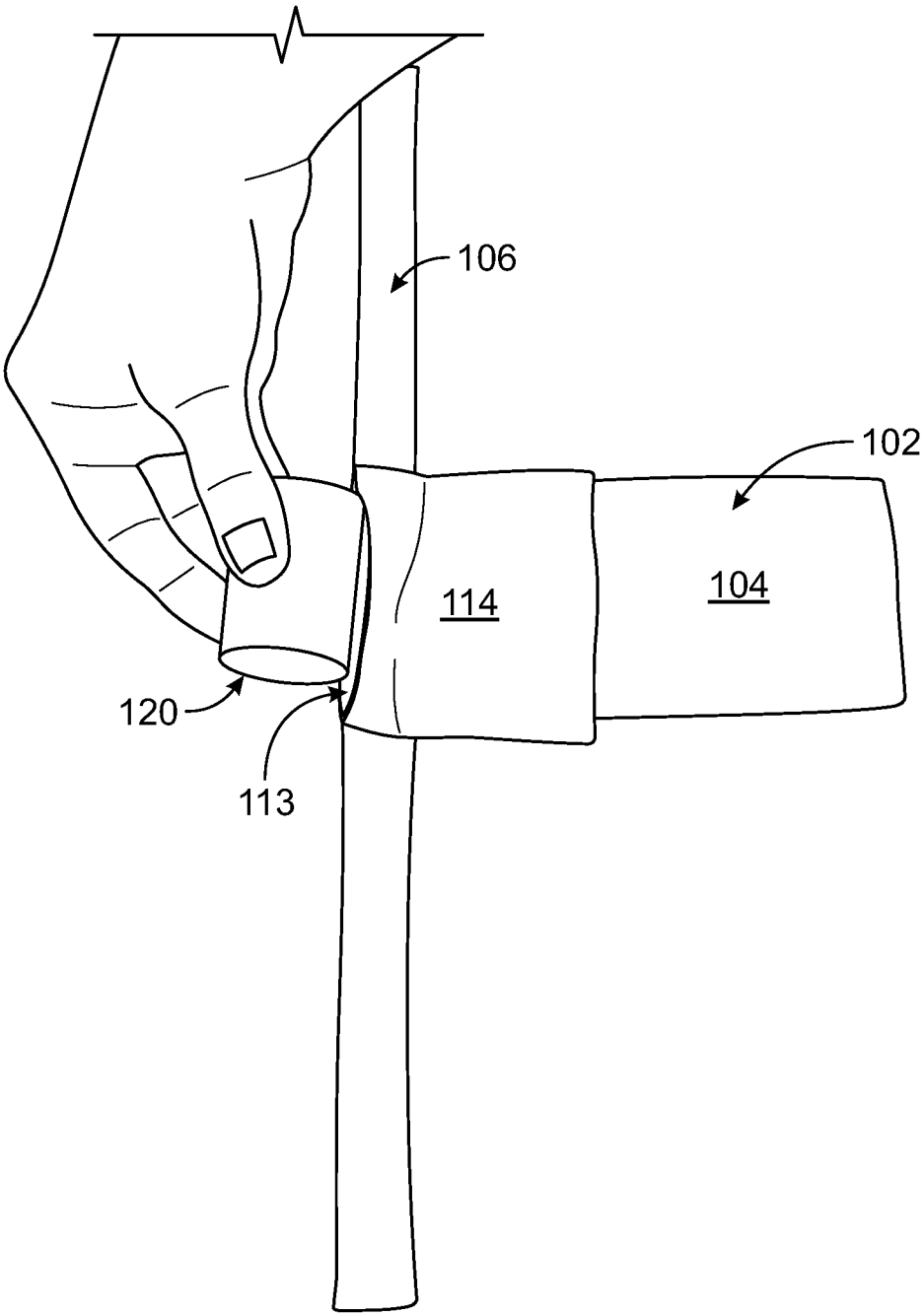
FIG. 14 depicts a pictorial illustration of the detachable hair pocket attached to the hair curler and a roller being inserted within the cavity of the detachable hair pocket.
Figure 15:
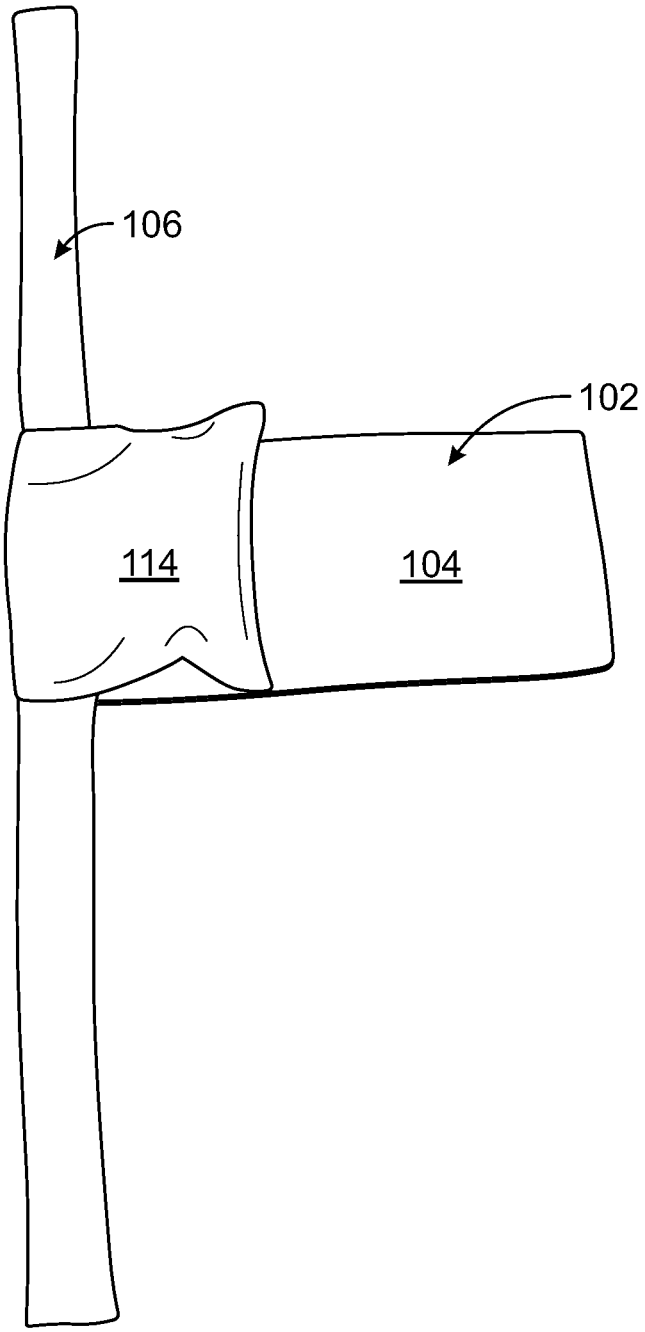
FIG. 15 depicts a pictorial illustration of the roller within the detachable hair pocket while attached to the hair curler.

FIG. 14 shows the detachable pocket 114 attached to the hair pocket 104 of the hair curler 102 and also shows the user inserting a separate tangible hair roller 120 into the interior cavity 113 of the detachable pocket 114 and FIG. 15 represents the hair roller 120 inserted within the detachable hair pocket 114 as attached to the hair pocket 104 of the hair curler 102.

Figure 2:
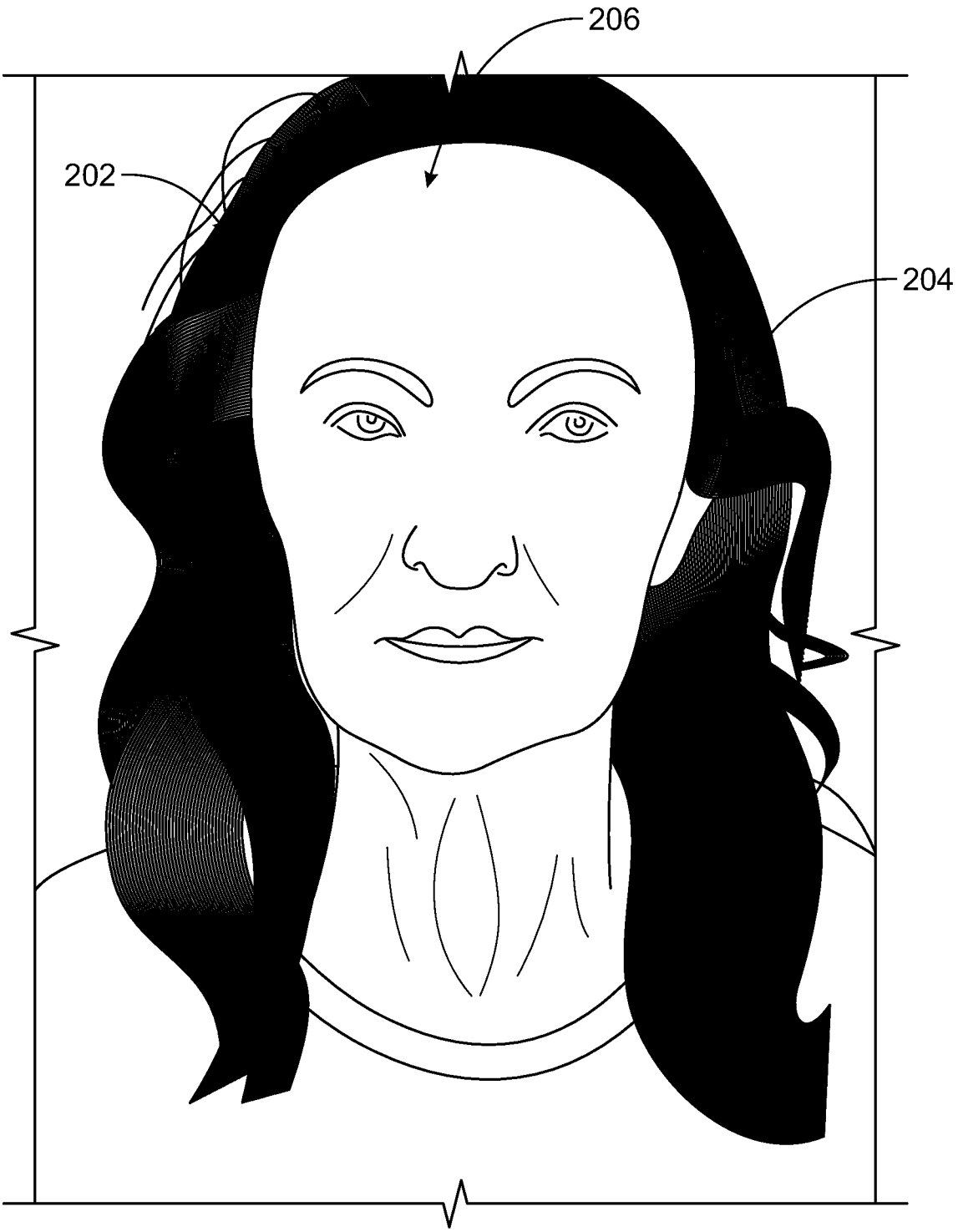
FIG. 2 depicts a pictorial illustration of a user before using the one or more hair curlers to style the user's hair.

FIG. 2 shows a pictorial illustration of a user 202 of the hair curling system 100 and hair curler 102. The user 202 in FIG. 2 is shown having uncurled, un-styled hair before the use of the hair curlers 102 and/or detachable roller pockets 114 to curl the user 202's hair 204.

Figure 3:
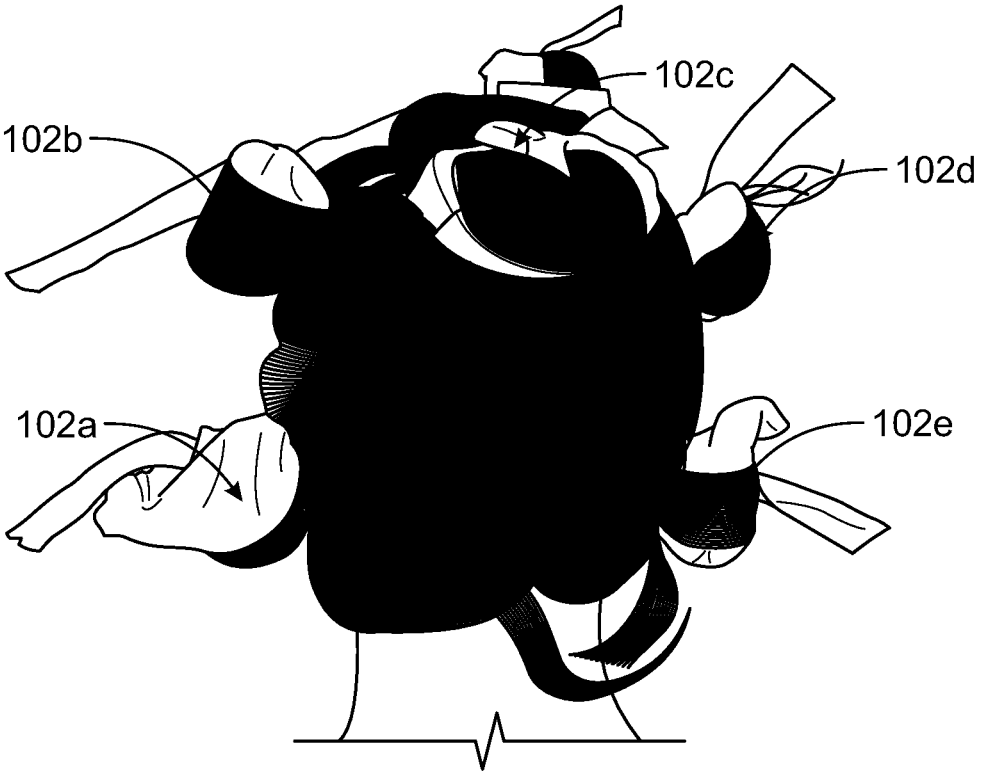
FIG. 3 depicts a pictorial illustration of a user with the hair curlers tied on various assembled sections of hair on the user's head.

FIG. 3 displays the user 202 with several cloth or fabric hair curlers **102*a*, 102*b*, 102*c*, 102*d*, and 102*e* rolled into the user's hair 204. As shown in FIG. 3, multiple hair curlers 102*a*-102*c* are each separately rolled to curl the user's whole head 206 of hair 204. The user 202 may roll as many hair curlers 102 in the user's hair 204 in order to cover all or part of the user's head 206 to achieve the desired look and to suit the hair length of the user 202. As shown in FIG. 3, the user 202 utilizes six hair curlers 102*a*-102*e* to cover the head 206 of hair 204. The number of curlers 102 may vary depending on the length of the user 202's hair 204 as well as other factors including hair texture and the desired style and final look. As described later below, the user 202 can achieve more defined and tighter looking curls 402 and waves 404 (e.g., as shown in FIGS. 4-5) by including a roller in the hair curler 102 and the interior cavity of the hair pocket 104**.

The number of hair curlers 102 used by the user 202 may be needed to roll the hair 204 for a period of time in order to transition from an un-styled look, as shown in FIG. 2, to the styled hairstyle shown in FIGS. 4-5. FIGS. 4-5 show the end result of a styled head of hair 204 having curls 402 and waves 404.

Notably, the assembly of hair curlers **102*a*-102*e* shown in FIG. 3 and the selected amount of hair 204 may advantageously be used in the user's hair 204 to achieve a styled head of hair 204 without having to wet the user's hair 204. The hair curlers 102 will usefully cause the hair 204 to curl regardless of the user 202 having wet his or her hair or use potentially damaging styling products in the user 202's hair. This is different from most curling devices and systems which requires the hair to be wet and the user 202 to sleep with the wet hair and curling system in order for the natural curls and waves to occur. FIGS. 4-5 display that the natural looking curls 402 and waves 404 can be achieved using a particular number of hair curlers 102 and the selected amount of hair 204**.

Figure 6:
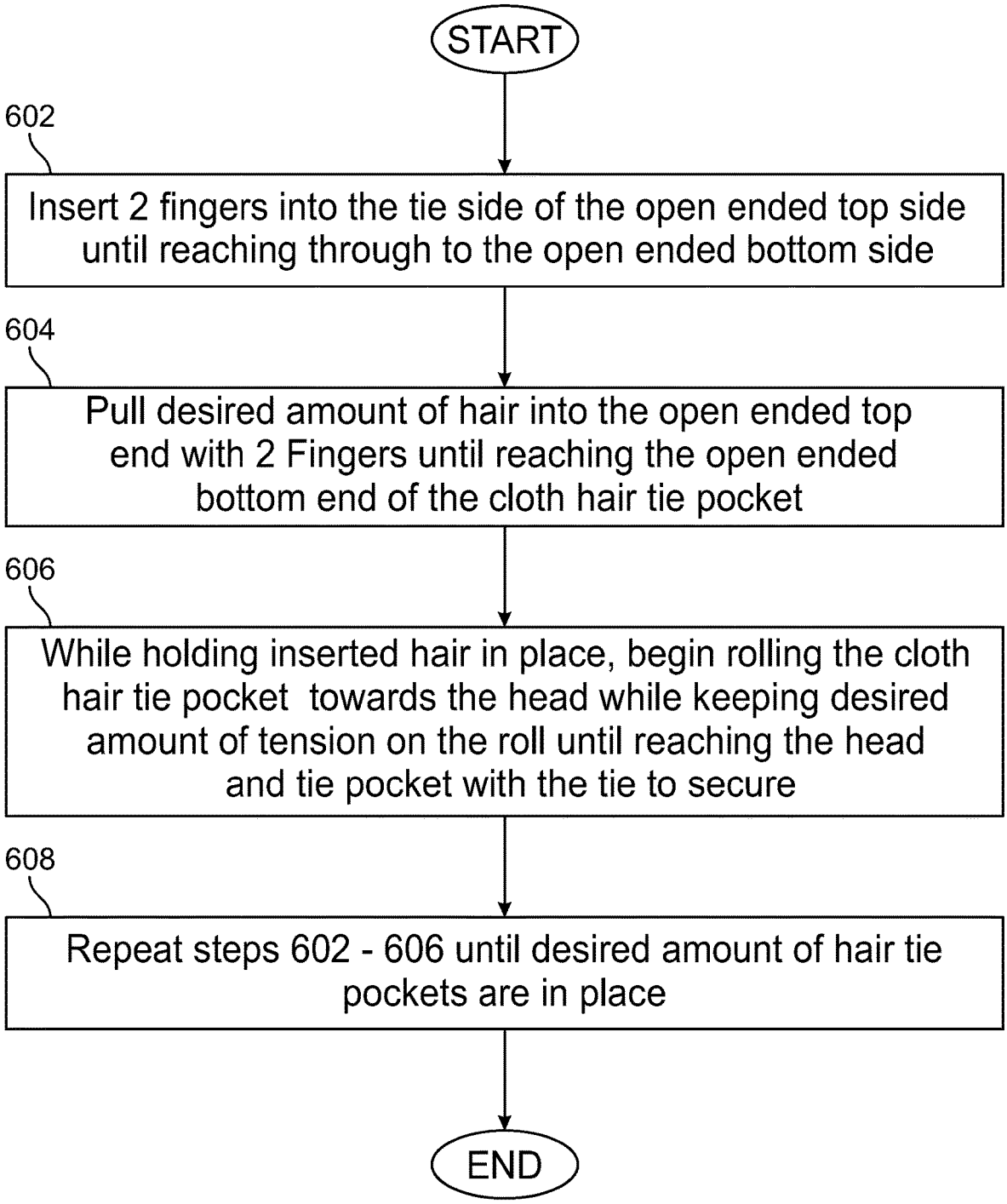
FIG. 6 depicts an exemplary flowchart of how to apply the one or more hair curlers to one's head.
Figure 11:
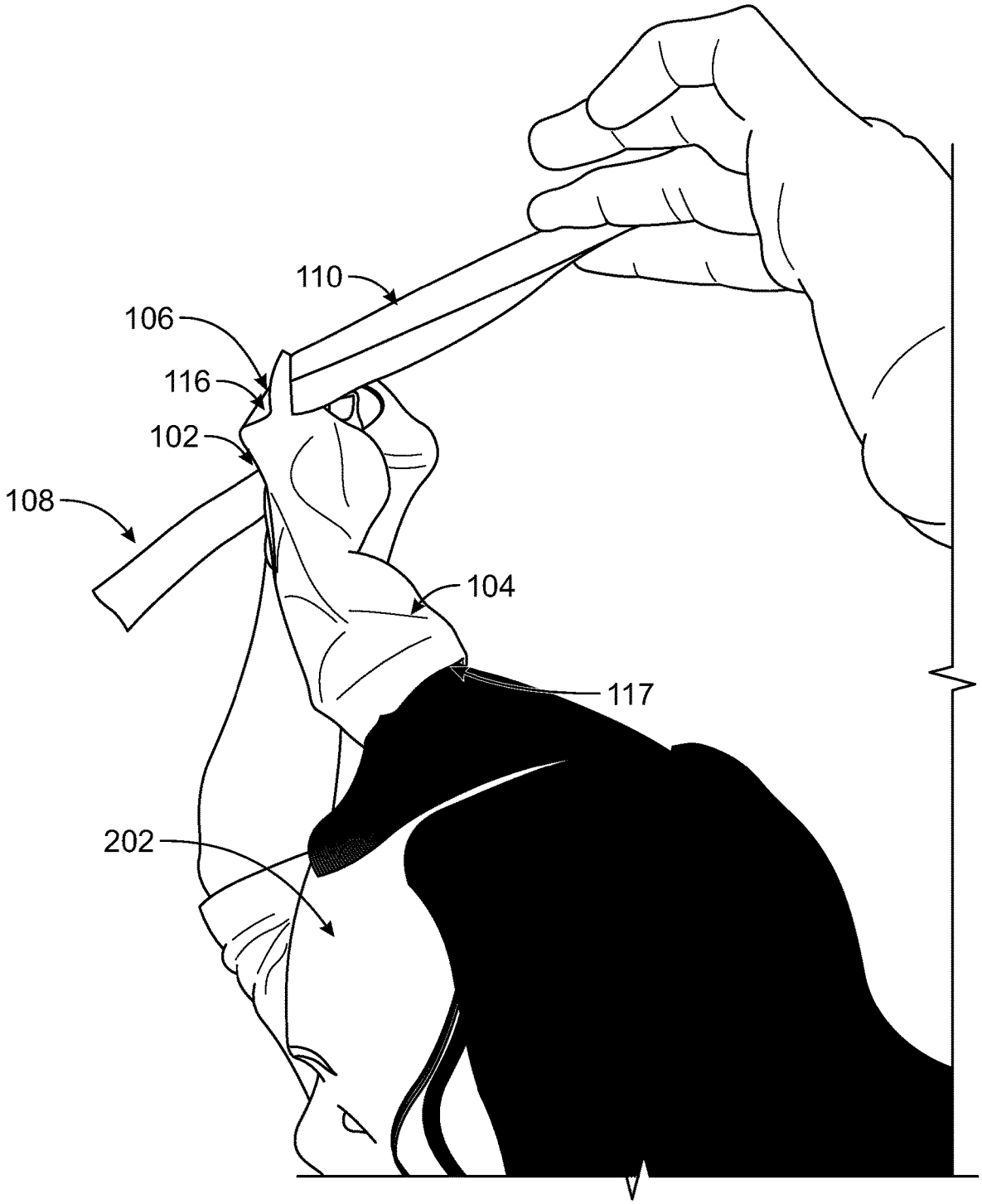
FIG. 11 depicts a pictorial illustration of a side view of the section of hair gathered and inserted within the extended, unrolled hair curler.
Figure 12:
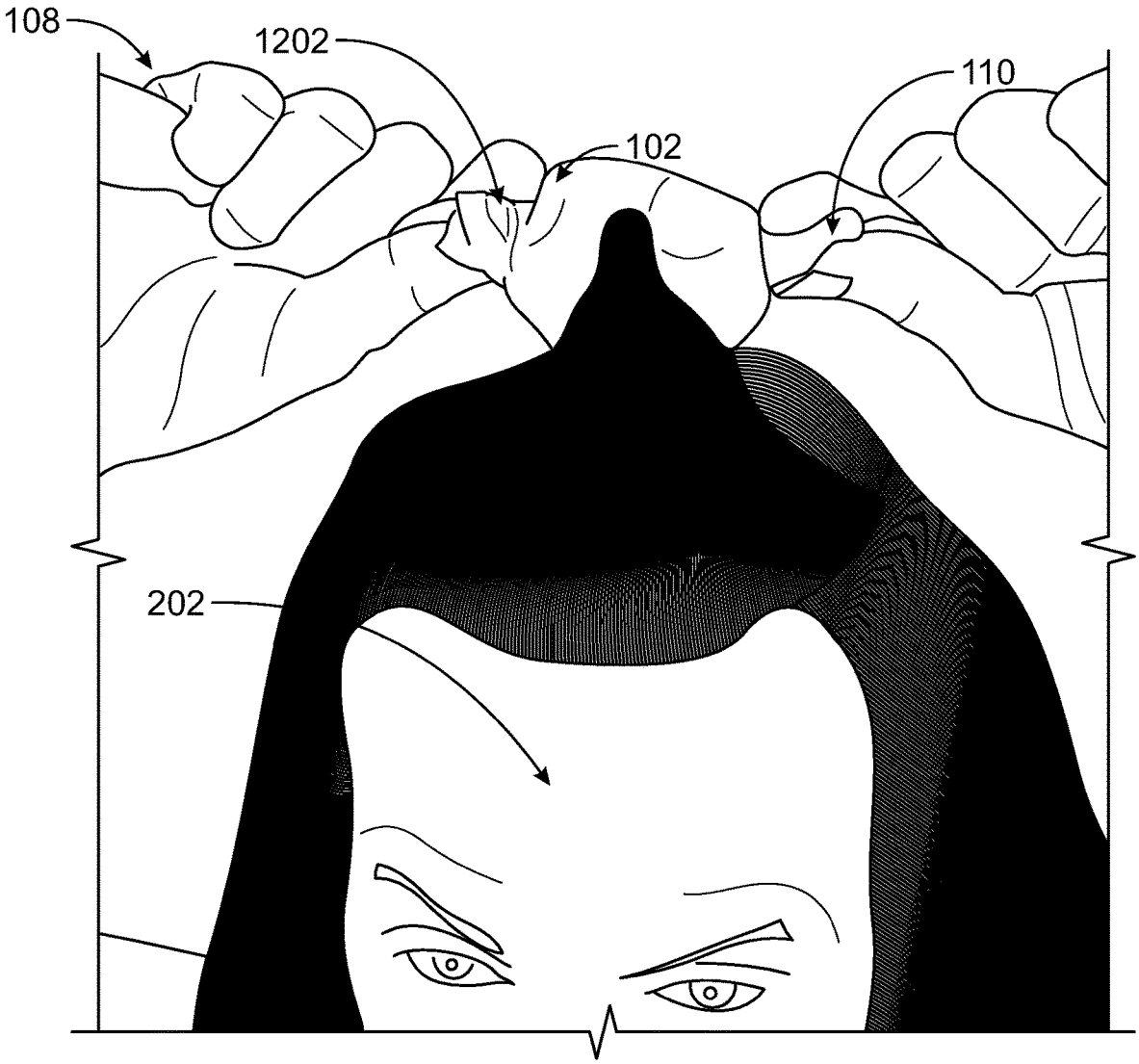
FIG. 12 depicts a pictorial illustration of gathered hair strands being tied together and held in place using a hair curler.

FIG. 6 is an exemplary flowchart and pictorial illustration of the steps for achieving natural looking curls 402 and waves 404 as described above and as shown in FIGS. 4-5. At step 602, as shown in FIG. 6, in a non-limiting embodiment, the user 202 may insert two fingers into the open-ended top side 116 closest to the tie 106 (also known as the "tie-side" of the hair curler 102) of the open-ended pocket 104 until reaching through to the opposite open bottom end 117. This is also shown in FIGS. 11-12, in which the user 202 prepares to insert two fingers 702 on one hand through the tie-side or end 116 of the hair curler 102 and insert through to the opposite end 117

Figure 7:
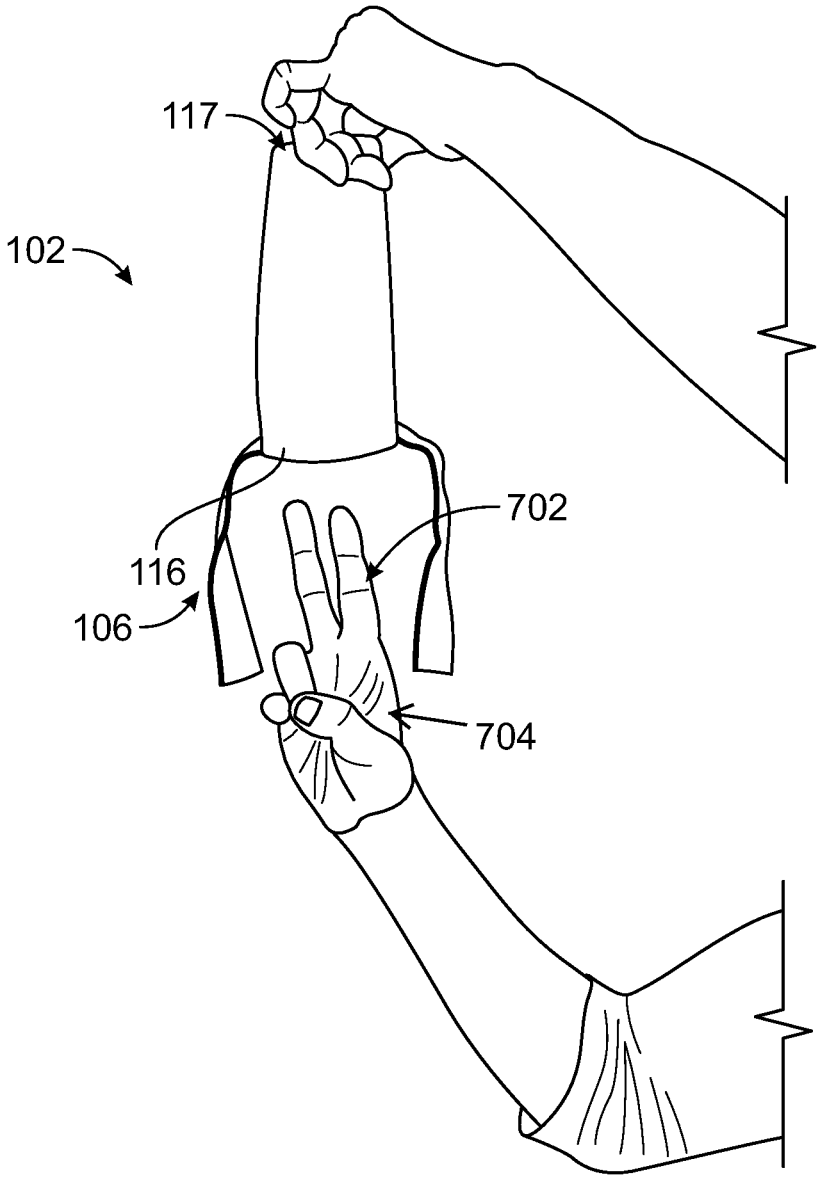
FIG. 7 depicts a pictorial illustration of a hair curler in preparation for placement in a user's hair.
Figure 9:
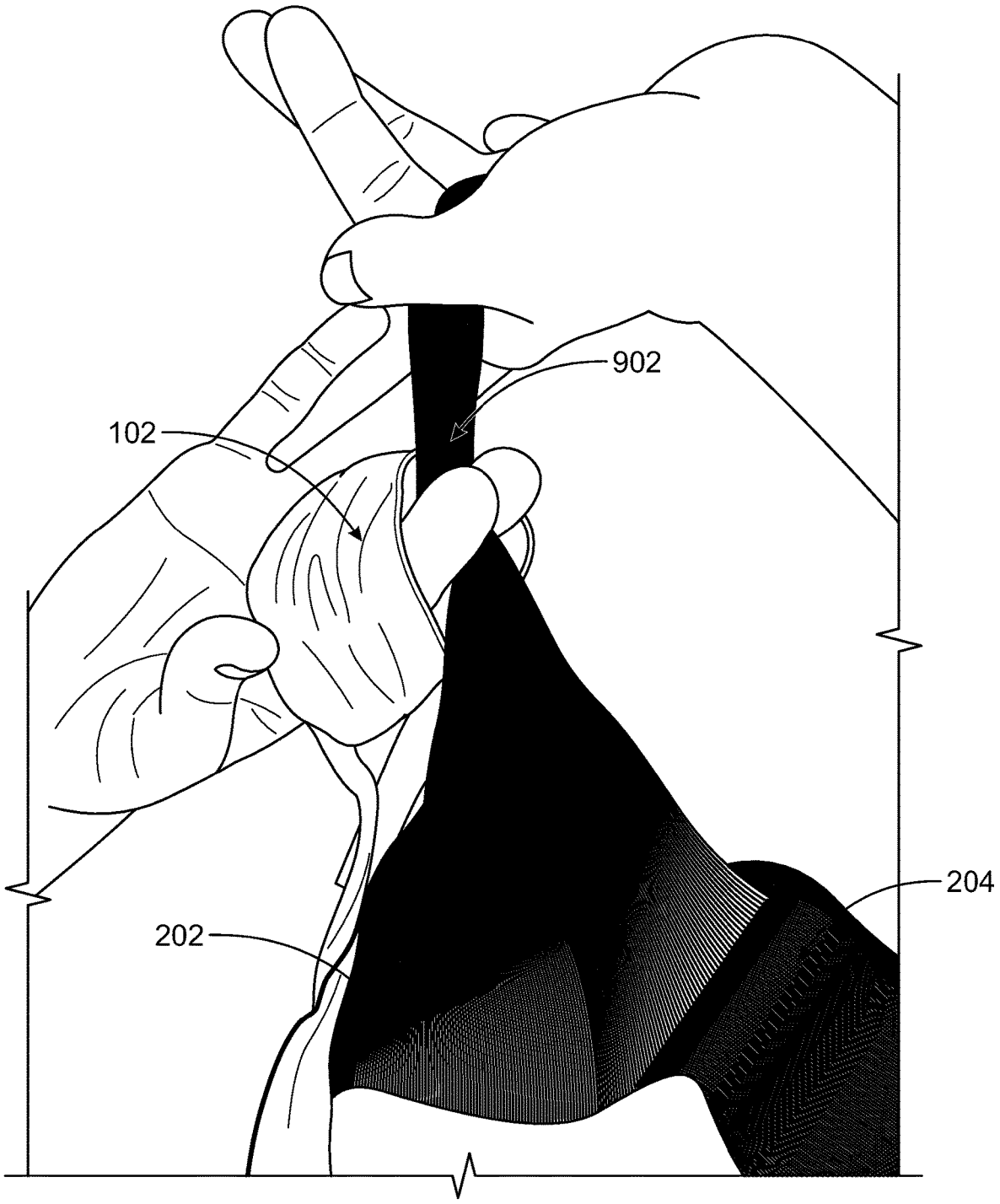
FIG. 9 depicts a pictorial illustration of user gathering a section of hair to insert into opening of hair curler.
Figure 10:
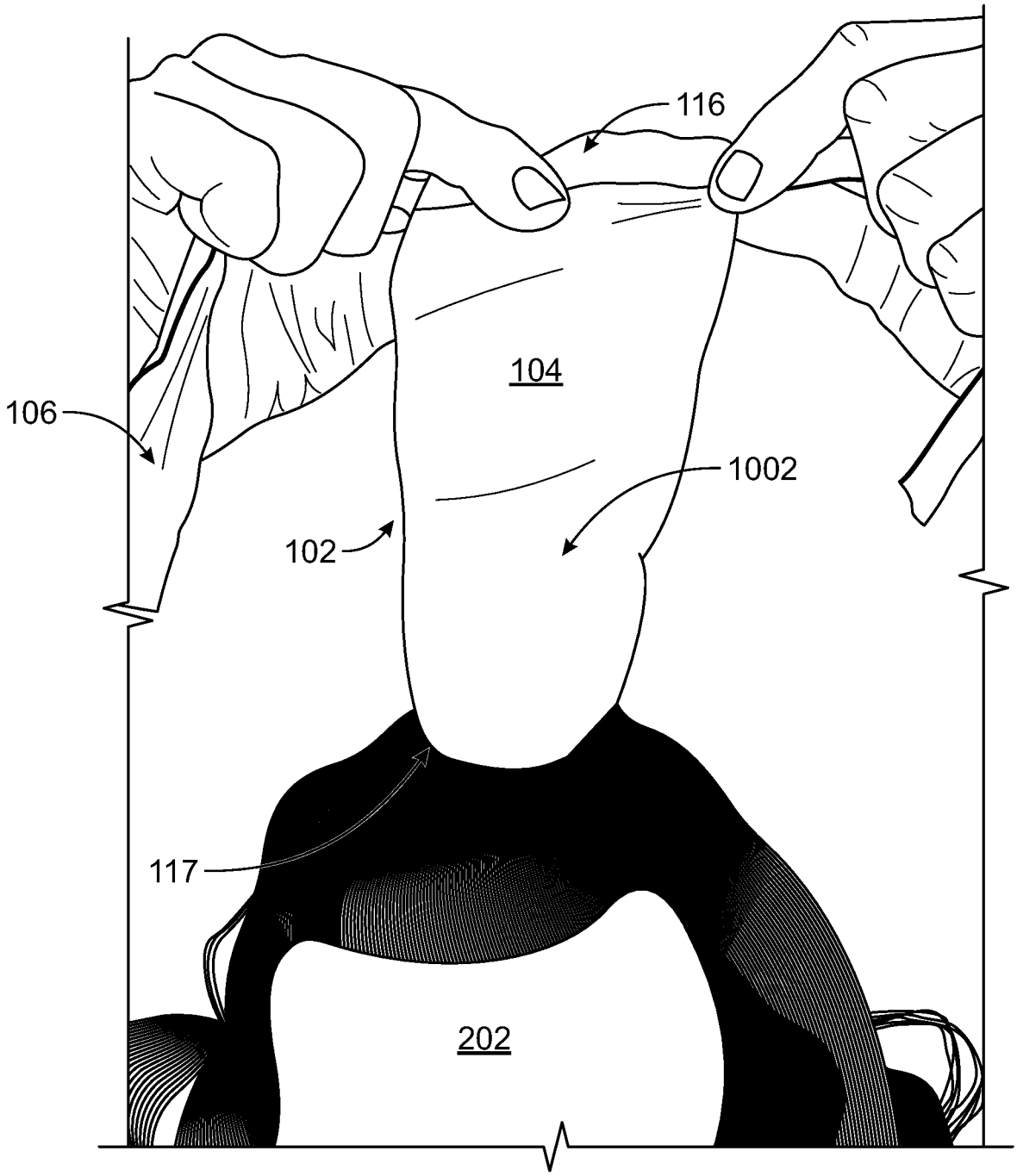
FIG. 10 depicts a pictorial illustration of the section of hair gathered and inserted within the extended, unrolled hair curler.

Referring back to FIG. 6, at step 604, the user 202 may pull the desired amount of hair 204 (e.g., which may be the same as a section of hair 902 as shown in FIG. 9) into the second open end 117 on the opposite of the tie side of the hair pocket 104 with two fingers 702 from a user's hand 704 until reaching the first open end 116 of the pocket 104 (e.g., as shown in FIG. 7). The user 202 should preferably not allow the section of hair to extend past the first end 116 of the hair pocket 104. As shown in FIG. 10, the section 902 of hair 204 should extend through the cavity 105 of the hair pocket 104 once the user 202 has pulled the desired section 902 of hair 204 through the cavity 105 of the hair pocket 104. FIG. 10 shows a visual representation or combination 1002 of the section of hair 902 contained within the cavity 105 of the hair curler 102 as described in step 604.

At step 606, once the section 902 or desired amount of hair 204 is in the cavity 105 of the individual hair curler 102 and hair pocket 104 of the hair curler 102, the user begins to roll the hair curler 102 towards the user 202's head 206 while preferably keeping a desired amount of tension on the roll until reaching the head 206. At this point the user may tie the hair curler 102 using the tie 106 (via first tie end 108 and second tie end 110 as shown in FIGS. 1A-1C and in FIG. 11). The user 202 may preferably tie the hair curler 102 into a loose knot 1202 as shown in FIG. 12 in order to achieve the assembly of hair 204 and hair curler 102 that will produce natural looking curls 402 and waves 404 after a certain period of time in which the loose knot 1202 is left in or on the user 202's head 206. At step 608, the user 202 may repeat the above-mentioned process or steps 602-606 until the desired amount of hair curlers 102 (and/or detachable hair pockets 114) are in place.

Figure 16:
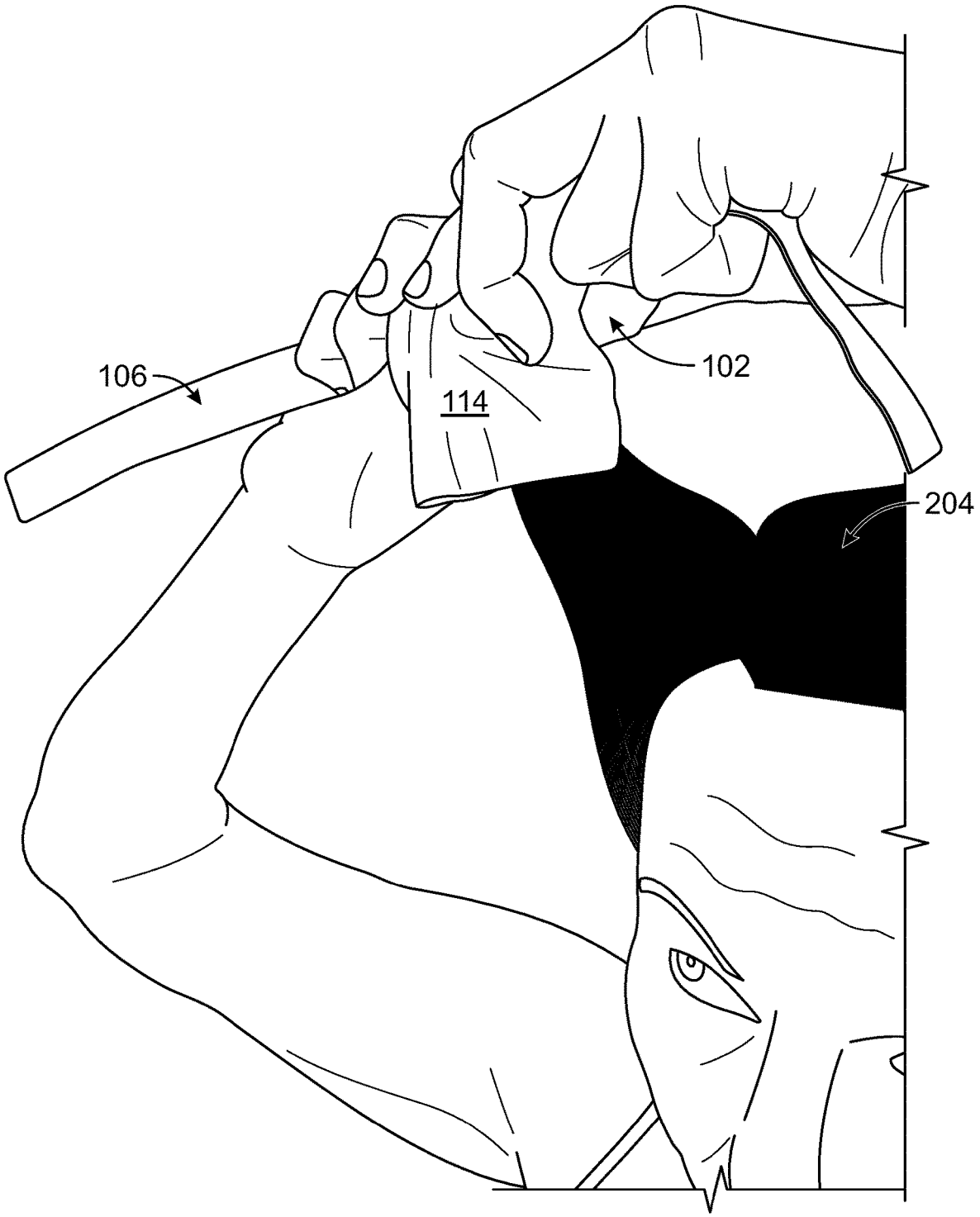
FIG. 16 depicts a pictorial illustration of the detachable hair pocket with the inserted roller and hair curler being used to curl a section of hair of a user.

FIG. 16 provides an example of how a user may include a detachable pocket 114 attached on top of the front face of the pocket 104 of the hair curler 102. The user would attach the detachable pocket 114 so that the second corresponding fastener 122*b* mates with or removably attaches to the first fastener 122*a* on the hair tie 106 of the hair curler 122. As noted above, in one embodiment both the first fastener 122*a* and the second corresponding fastener 122*b* are hook and loop fasteners and may mate together by attaching the hook and loop fastener pieces together. In other cases, the user may button corresponding buttons, snaps, clips, or other types of fasteners used for first fastener 122*a* and second fastener 122*b*. The user may further insert the separate hair roller 120 as shown in FIG. 14 and in FIG. 15. As shown in FIG. 16, the user may insert the desired amount of hair in the cavity 105 of the hair curler pocket 104 using two fingers 702 as shown in FIG. 7 to pull the desired amount of hair 902, as shown in FIG. 9, into the cavity 105 of the hair pocket 104 (while the detachable hair pocket 114 is attached to the hair pocket 104). Once the hair 902 is inserted into the cavity 105 of the hair pocket 104 of the hair curler 102, the user may tie the hair tie 106 around the roots of the hair 902 and thus the hair curler 102 is in place with the attached detachable pocket 114 having the inserted hair roller 120, which is shown in FIG. 16. As noted above, the removable hair roller 120 when inserted in the detachable pocket 114 and rolled with the hair curler 102 can help provide further tightness and definition to the produced curl after the connected hair curler 102 is removed from the hair.

The following provides a general description for how to make an exemplary hair curler 102 according to one or more non-limiting embodiments. In a non-limiting embodiment, the hair curler 102 may be made from cloth. Further, as further described below, there may be a silk-based lining on the interior pocket 104 defining the cavity 105 of the hair curler 102 in order to avoid any hair breakage or damage to the user 202's hair 204 when using the hair curler 102.

To make a hair curler 102, a user 202 or another party may cut cloth fabric (e.g., 100 percent cotton fabric). In a non-limiting embodiment, the user 202 may cut 9 inches for both sides of the hair pocket 104 and 7½ inches for both the top and the bottom of the hair curler 102. Both the 9-inch sides may be reinforced with a zigzag stitch. The top of the 7½-inch pocket may be folded down toward the center of the "wrong side" of fabric and folded down ½-inch two times. The bottom of the 9 inches may be folded up toward the center of the "wrong side" of the fabric and sewed to secure.

The cloth hair tie 106 may be secured to the bottom center of the hair pocket 104 on the "right side" of the fabric. The hair tie 106 should be secured 1½ inches from the center on both sides of the bottom of the hair pocket 104.

A first half piece of a hook and loop fastener 122*a*, may be attached to the center top of the "right-side" fabric of the hair pocket 104. It may be desirable to attach the soft side of the hook and loop fastener 122*a* to the hair pocket 104 so as to prevent any damage to the hair 204 if detachable roller picket 114 is not used The nine (9) inch sides may be sewed together with "right sides" of the fabric facing the "right side" of the fabric and stitched to secure in place. It may be desirable to leave a top and bottom of the hair pocket 104 open and to turn the pocket 104 "right side" out and ironed flat.

A lining may be inserted and secured at the top and bottom with the "right side" of the lining facing away from the pocket 104. The silky lining will be visible on the inside of the hair pocket 104 and will provide a smooth texture for the hair 204. The lining may be preferably attached to the hair pocket 104 only at the top and bottom of the hair pocket 104.

To incorporate the lining in the hair curler 102 and hair pocket 104, a top and bottom part of fabric may be cut at 7½ inches long and 9½ inches for the side of the fabric. The 7½ inch top of the lining may be folded down ½ inch toward the center of the "wrong side" of the fabric and performed twice. The lining may be pressed to flatten down and sewed to secure. The 7½-inch bottom side may be folded up toward the center of the "wrong side" of the fabric to about a ½ inch and performed twice. This section may be pressed to flatten and sewed to secure.

The 9½ inch sides may be folded together with the "right sides" facing each other, pressed to flatten, and sewed to secure. Further, the silk lining may be turned "right side" out and pressed to flatten.

To incorporate a tie portion 106 of the hair curler 102 with the hair curler 104, the fabric (e.g., 100 percent cotton fabric in a non-limiting embodiment) may be cut 17 inches for the top and bottom length and 2½ inches for both sides. Both 2½ inch sides may be folded in toward the center of the "wrong side" of the fabric 1 inch, pressed to flatten, and sewed to secure in place. The top 17-inch side may be folded to the bottom 17-inch side together and pressed flat and then sewed to secure in place. The fabric tie may be turned "right side" out and pressed flat, and then both sides of the hair tie 106 may be sewed to close both ends.

To make a detachable roller pocket 114, as shown in in one or more non-limiting embodiments in FIGS. 1A-1C, the fabric may be cut 8¼ inches for both sides of the pocket 114 and 4½ inches for the top and bottom of the pocket 114. The bottom of the fabric may be folded up towards the center of the "wrong side" of the fabric ½ inch two times. This section of fabric may be pressed with an iron and sewed to secure.

The top of the fabric may be folded down towards the center of the "wrong side" of the fabric ½ inch two times and then pressed to flatten (e.g., with an iron) and sewed to secure.

The bottom of the fabric may be folded to the top of the fabric with the "right sides" of the fabric together. Both sides may be sewed together secure leaving the top of the pocket 114 open to insert the roller 120 (e.g., as shown in FIGS. 1B-1C) if desired. A piece of hook and loop fastener (e.g., 1 inch×¾ inch and preferably oval shaped) may be attached to the top of the open end 113 of the roller pocket 114. It may be desirable to utilize only the second half of the hook and loop fastener 122*b* and may be desirable to attach the rough side of the hook and loop fastener 122*b* to the pocket 114 at its opening 113. This may help to prevent any damage to the hair 204 when the roller 120 is inserted within the detachable roller pocket 114.

Accordingly, the accompanying Figures display an exemplary structure and form of the hair curling system 100 which may include a (cloth) based hair curler 102, with integrated hair ties 106, and a detachable roller pocket 114. In some cases, preferably, a silky interior lining may be included within the interior of the hair curler pocket 104 to protect the user 202's hair 204. The hair curler system 100, as noted above, can achieve natural looking curls 402 and waves 404 without damaging a user 202's hair 204 as is the case with traditional styling tools and products that require heat and electricity. Further, the hair curling system 100 is lightweight and portable and may be easily stored in a user's bag or suitcase and taken with the user 202 to any location. Further, there is no requirement that the hair curlers 102 be applied to wet hair in order to achieve a desired number of curls 402 and waves 404, thereby making it more advantageous to the user 202. Many other benefits and advantages of the hair curler system 100 may be apparent.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with; and/or in the context of other particular aspects and embodiments of the invention; and in the invention generally.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any items, so a "set of items" may indicate the presence of only one item or may indicate more items. Thus, the term "set" may be equivalent to "one or more" as used herein.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A hair curling system, comprising:

a hair curler comprising:

a single, elongated section of fabric with a top open end and a bottom open end, and a closed left side and a closed right side, wherein a cavity extends through the elongated section of fabric, wherein the single elongated section of fabric is secured by sewing one side of the single elongated section of fabric to another side to form the closed left side and the closed right side and the cavity that extends therethrough, wherein the cavity is defined by the closed left side and the closed right side and the top open end and the bottom open end and wherein the cavity is enclosed by the closed left side and the closed right side;

a hair tie attached to a top edge of the top open end of the elongated section of fabric, wherein a first fastener is attached to a center piece of the hair tie, and wherein the hair curler is configured to be used to curl a desired amount of hair; and a detachable pocket having an interior cavity configured to receive a separate hair roller, wherein the detachable pocket comprises a closed left side, a closed right side, a closed bottom side, and an open top side, wherein the detachable pocket comprises a second corresponding fastener to mate with the first fastener to removably attach the detachable pocket to a top central surface of an exterior of the single elongated section of fabric.

2. The hair curling system of claim 1, wherein the hair curler is made of cloth.

3. The hair curling system of claim 1, wherein the hair curler comprises a lining.

4. The hair curling system of claim 3, wherein the lining is made of a silky fabric.

5. The hair curling system of claim 1, wherein the first fastener and the second corresponding fastener are hook and loop fasteners.

6. The hair curling system of claim 1, wherein no heat is required to use the hair curler.

7. The hair curling system of claim 1, wherein a width of the hair tie is wider than a width of the single, elongated section of fabric.

8. The hair curling system of claim 1, wherein the separate hair roller is configured to fit within the interior cavity of the detachable pocket.

9. The hair curling system of claim 1, wherein a length of the detachable pocket is shorter than a length of the single, elongated section of fabric.

10. The hair curling system of claim 1, wherein the second corresponding fastener is located generally near a top edge of a back side of the detachable pocket in order to attach to the first fastener attached to the center piece of the hair tie.

* * * * *